United States Patent [19]

Stearns

[11] 4,100,950

[45] Jul. 18, 1978

[54] END DOGGING FEEDING DEVICE

[76] Inventor: Clyde W. Stearns, Box 1016, Kalispell, Mont. 59901

[21] Appl. No.: 762,939

[22] Filed: Jan. 26, 1977

[51] Int. Cl.[2] ..... B27C 1/12

[52] U.S. Cl. ..... 144/242 D; 83/435.2; 83/731; 144/245 A; 144/312; 198/485; 198/604; 198/626

[58] Field of Search ..... 83/730, 409, 435.1, 83/435.2, 731, 435 R; 198/626, 620, 750, 485, 604; 144/242 R, 242 D, 245 R, 245 D, 3 P, 245 A, 312; 214/1.1

[56] References Cited

U.S. PATENT DOCUMENTS

| | | | |
|---|---|---|---|
| 3,875,841 | 4/1975 | Noble | 83/435.1 |
| 3,960,041 | 6/1976 | Warren et al. | 83/435.1 |
| 4,009,632 | 3/1977 | Detjen | 144/242 D X |

*Primary Examiner*—Othell M. Simpson
*Assistant Examiner*—W. D. Bray
*Attorney, Agent, or Firm*—LeBlanc & Shur

[57] ABSTRACT

A device for continuously feeding logs into a machine center to cut or chip pieces from the sides thereof is disclosed. The device includes opposed upper and lower tracks mounting upper and lower endless drive chains. Each drive chain mounts a plurality of spaced dogs adapted to be disposed in alternating sequence of upper and lower pairs, each dog having a horizontally directed gripping surface whereby a log may be gripped between a pair of upper and lower dogs and fed through a machine cutting center. As a first log held by a pair of upper and lower dogs passes through the machine, a second pair on each chain rotates into a feeding position for gripping a second log to be taken through the machine. The device also includes associated centering and positioning members to align logs entering the machine, conveyors for cut pieces, and means for interlocking the upper dog in the lower track as the log gripped thereby passes through the machine center.

12 Claims, 5 Drawing Figures

END DOGGING FEEDING DEVICE

This invention relates to an improved device for feeding logs through a machine cutting center to cut or chip pieces from the sides thereof and to stabilize the center flitch against lateral movement as it passes through the center. Specifically, the device of this invention is intended to provide a means for continuously feeding logs of predetermined length through opposed chipping heads and/or opposed band mills whereby the center portion is stabilized as the sides are cut off. In addition, as one log passes through the machine center, the device of this invention continuously aligns and grips the next log and feeds said log into the center.

The prior art contains a variety of material handling devices adapted to feed articles on an endless belt or track into a machine center for cutting, sawing or the like. In sawmill operations, however, it has been the practice to align logs on a track and utilize a single dog on the track to push the log through an aligning cradle into the sawmill. However, in the case where the sides of the log are to be removed by opposed chipping heads or opposed band mills, considerable lateral movement of the log during cutting was experienced. Lateral movement was principally caused by vibration as the sides of the log are removed, and this lateral movement of course results in inprecise cutting and waste.

It has been discovered, however, that logs passing through such a machine cutting center can be stabilized against lateral movement by utilizing a pair of dogs mounted on upper and lower tracks which grip the center portion of the opposed faces of the log. By mounting the dogs on separate tracks, gripping pressure may be exerted between the dogs to stabilize the log during cutting. Furthermore, additional stability against lateral movement is provided by the device of this invention wherein the distal portion of the upper dog is adapted to ride in a groove or chainway in the lower dog track when the log is gripped.

The device of this invention then includes upper and lower endless chains contained in tracks disposed in alignment which extend through the machine center. The path of rotation of both the upper and lower endless chains is contained in a common vertical plane. During operation, both chains rotate, and the path of rotation of the lower chain is in the direction of movement of the log through the machine center while the path of rotation of the upper chain is in the opposite direction. As a result, a depending dog on the upper chain engages the leading face of a log entering the device, and an upstanding dog in the lower chain engages the rear face of said log to hold the log therebetween as it passes through the machine center.

Accordingly, it is an object of this invention to provide a feeding device for logs which is adapted to continuously feed logs into a machine center where the sides thereof are cut or chipped away.

It is another object to provide a feeding device for a machine center which will hold logs aligned therewith against lateral movement as said logs pass through the center.

It is still another object to provide a end dogging machine adapted to grip either end of a log and move said gripped log horizontally through a machine center wherein the sides are cut or chipped away.

It is yet another object to provide vertically aligned tracks carrying endless chains mounting pairs of spaced dogs adapted to grip the ends of logs of predetermined lengths, and hold the center portion against lateral movement as the sides are chipped or cut away and thereafter release the center portion for subsequent milling and sequentially feed, cut and release said logs on a continuous basis.

These and other objects will become readily apparent with reference to the drawings and following description, and wherein.

Figure 1:
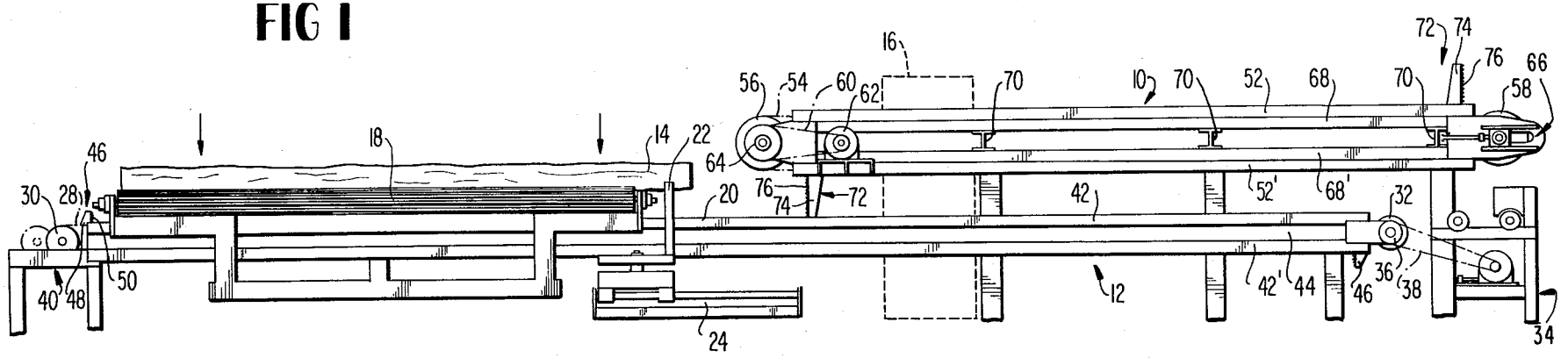
FIG. 1 is a front view of the device of this invention with a log entering.
Figure 2:
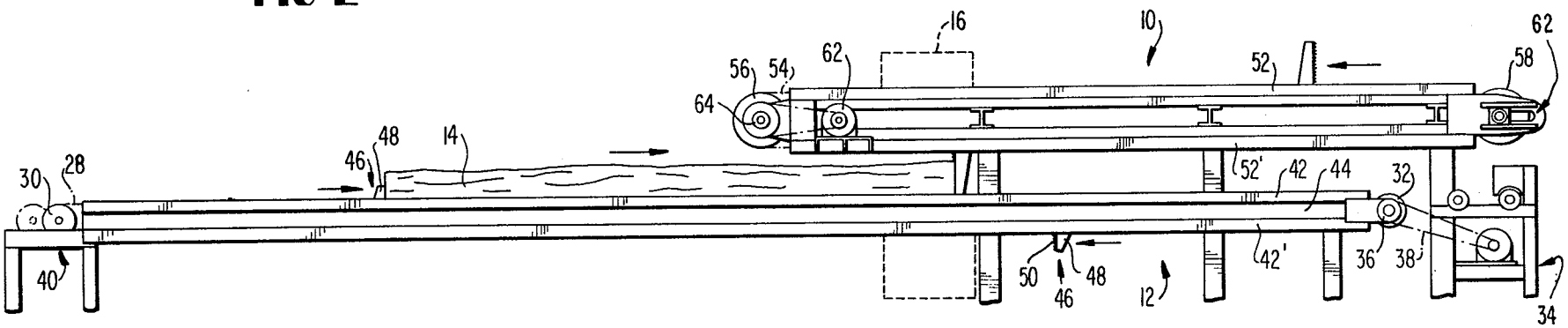
FIG. 2 is a front view of the device of this invention showing a log gripped and moving therethrough.

With attention to FIGS. 1 and 2, the feeding device of this invention comprises broadly an upper track assembly 10 and a lower track assembly 12 which are utilized to feed a log 14 through a machine center generally shown in schematic form at 16. The machine center 16 preferably would comprise opposed chipping heads utilized to chip the sides of a log off leaving two flat parallel sides, and twin band saws to produce two side boards and one center flitch. The chipping heads and band saws are well known to those skilled in the art and accordingly are not part of the instant invention and therefore shown merely in schematic form in phantom.

Figure 3:
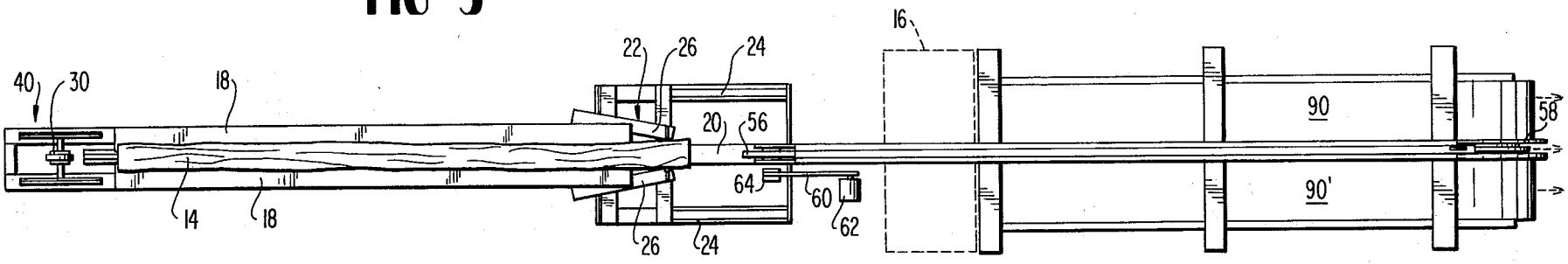
FIG. 3 is a plan view of the device of this invention with a log in the position illustrated in FIG. 1.
Figure 5:
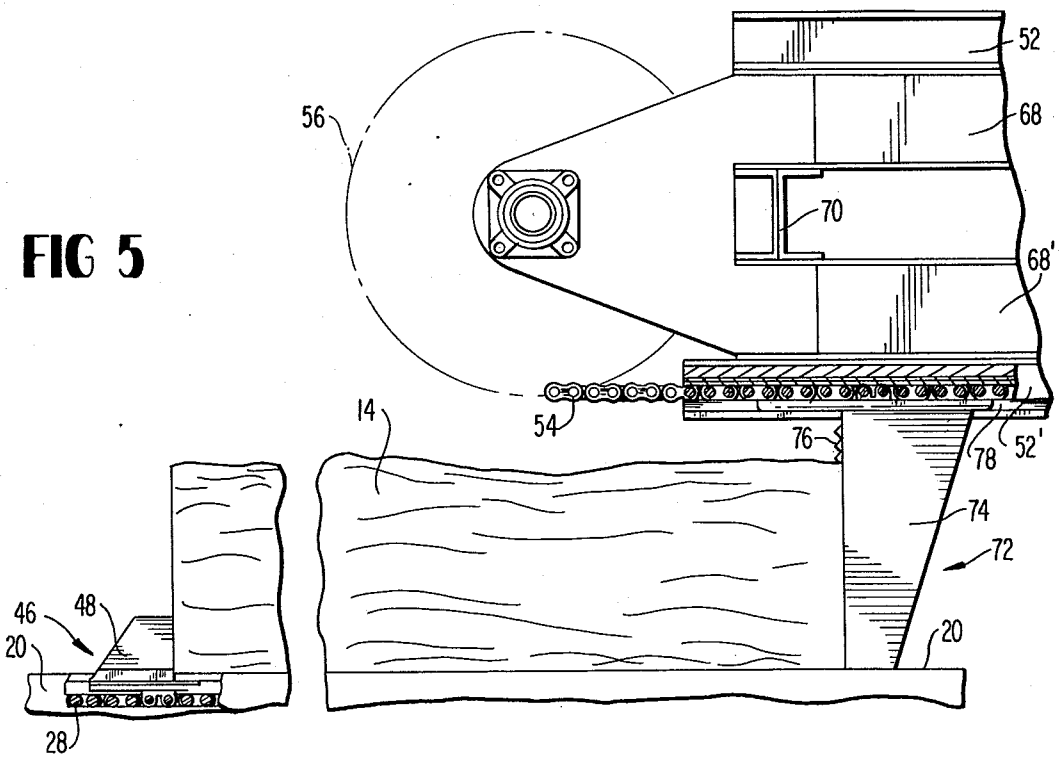
FIG. 5 is a fragmentary front view in partial section of the device of this invention illustrating the gripping action of the front and rear dogs as a log passes therethrough.

Lower track assembly 12 includes twin log turning rolls 18, shown in FIGS. 1 and 3 which receive an incoming log, rotated to the best cutting position, and lower it onto the lower track 20 and on log positioning carriage 22. Carriage 22 is slidable on its carriage track 24, and with reference to FIG. 3, includes twin biased arms 26. Carriage 22 functions as an automatic centering device with manual taper control and translates horizontally along track 24 toward machine center 16 until the log is gripped between both the upper and lower track assemblies. The carriage then releases the log and retracks to the position shown in FIG. 1. Carriage 22 has been deleted from FIG. 2 in the interest of clarity.

Lower assembly 12 comprises an endless chain drive 28 adapted to rotate between sprocket wheels 30 and 32. Chain drive 28 is driven by motor 34 connected to sprocket wheel 32 by pulley 36 and belt 38. Sprocket wheel 30 then is a follower only, but as shown in phantom on FIGS. 1 and 2 may be displaced along its mounting assembly 40 in order to tighten chain 28 as desired. Assembly 12 also comprises upper and lower chainways 42 and 42' supported by a chainway support 44. Chainways 42 and 42' house the chain 28 as it rotates between sprocket wheels 30 and 32.

A plurality of lower dogs 46 are mounted on chain 28 and travel along chainways 42 and 42' as the chain 28 travels between rotating sprocket wheels 30 and 32. Dogs 46 are rigidly attached to chain 28 in any conventional manner, and include a support portion 48 with a horizontally directed gripping face 50 which is adapted to engage the center portion of the rear face of a log as shown in FIG. 2.

The upper track assembly 10 comprises upper and lower chainways 52 and 52'. Drive chain 54 extends between sprocket wheels 56 and 58 through chainways 52 and 52'. Sprocket wheel 56 is driven by belt 60 connecting motor 62 and pulley 64 as shown in FIG. 3. Sprocket wheel 58 is then a follower wheel which is longitudinally adjustable by sliding on mount 66 to tighten chain 54 as required.

Chainways 52 and 52' are supported by longitudinal flange supports 68 and 68'. In addition, I-beam cross supports 70 are disposed between flange supports 68 and 68' for additional stability.

Chain 54 mounts a plurality of upper dogs 72 which comprise an upright support 74 and a horizontally directed gripping surface 76. As shown in FIG. 2, gripping surface 76 is adapted to grip the central portion of the leading face of log 14 as it enters the device. As chain 54 travels between sprocket wheel 56 and 58 along chainway 52, dogs 72 travel in a track 78 shown for example in FIG. 4.

Figure 4:
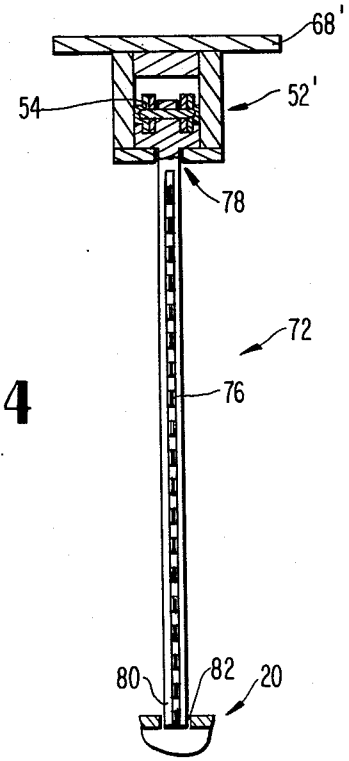
FIG. 4 is a fragmentary view in partial section of the upper dog and chain drive.

As dogs 72 travel through chainway 52', the depending distal portion thereof 80 is adapted to ride in the chainway 42 which defines a similar track 82 in deck 20 as shown in FIG. 4. By interlocking dog 72 in lower track 82 of feed deck 20, dog 72 will be stabilized against lateral movement as the log passes through machine cutting center 16.

With reference to FIG. 3, twin conveyor belts 90 and 90' are provided on each side of the lower track 12 downstream of the cutting center 16. Belts 90 and 90' are deleted from FIGS. 1 and 2 in the interest of clarity, but are designed to catch side lumber which falls away from the center flitch as its exits the cutting center 16. Belts 90 and 90' convey the side lumber to an edger or other equipment for resawing.

The center flitch exiting the cutting center 16 in deck 20 is released as dog 72 rotates around sprocket wheel 58. A trough (not shown) may be provided to transfer the center flitch into an edger or resaw feedworks further downstream (not shown).

In operation, the device of this invention engages the rear face of log 14 as rollers 18 place the log on deck 20, and dog 46 pushes log 14 into the taper correction device 22.

As log 14 emerges from the taper correction device 22, chain 54 rotates upper dog 74 into position whereby dog 74 encounters the leading face of log 14. As log 14 moves against the upper clamping dog 74, clamping pressure is generated instantaneously and the log is then held in position through the entire cutting sequence.

The drive system for chain 54 and chain 28 is preferably hydraulic variable speed drive fully reversable. Two independent hydraulically operated systems are preferred with one being for each chain.

Once the log 14 is clamped between dogs 74 and 46, the log moves through the machine cutting center 16 where preferably opposed chippng heads remove the sides of the log leaving two flat parallel sides, and then into twin band saws which produce side boards and one center flitch. The center flitch remains engaged between dogs 74 and 46 as the log passes through the cutting center and along deck 20.

As the cut portion emerges from the cutting center 16, the side lumber falls away on parallel belts 90 and 90' to be conveyed to a downstream edger or resaw feedworks.

The center flitch exits the system for further processing as the dog 74 rotates through sprocket wheel 58 into the position shown in FIG. 1. A second dog then, as shown in FIG. 1, is positioned on both chains 28 and 54, and a second log 14 is positioned by rollers 18 on deck 20 for sawing.

In a preferred embodiment of this invention, logs may be processed having a maximum diameter of about 18 inches, and in lengths of from 6 feet to 21 feet. The feeding mechanism is capable of feeding 6 logs per minute through the cutting center, on a continuous basis, depending, as will be obvious to those skilled in the art, upon the number of dogs provided on, respectively, chains 54 and 28.

In this fashion, then the device of this invention is capable of continuously feeding logs into a sawmill and maintaining the log against lateral movement during the sawing operation through the operation of opposed dogs on separate drive systems engaging the center portion of the ends of the log coupled with an interlocking of the upper dog in the track for the lower dog. In addition, a taper correction device is utilized to align the log with the upper dog whereby the center flitch may be accurately sawed from a variety of different shaped logs.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A feeding device for continuously feeding logs through a machine cutting center for removing the sides thereof to form a center flitch comprising:

a lower track assembly including a lower track having beginning, central and terminal portions, lower gripping means for engaging the center portion of the rear face of a log disposed in longitudinal alignment with said lower track, and first drive means coupled to aid lower gripping means for conveying said lower gripping means along said lower track from the beginning to the termination thereof;

machine cutting means disposed adjacent the center of said lower track for removing the side portions of a log as said log is conveyed through the central portion of said track;

an upper track assembly disposed over the central and terminal portions of said lower track assembly including an upper track, upper gripping means for engaging the center portion of the forward face of a log engaged by said lower gripping means before it enters said cutting means, and second drive means coupled to said upper gripping means for urging the log against said lower gripping means as said log is conveyed along said lower track through said cutting means;

said upper and lower gripping means being adapted to hold said log as it passes along said track through said cutting means and to release the center flitch of said log after the log passes through said cutting means; stabilizing means cooperable between said upper gripping means and said lower track for stabilizing said upper gripping means against lateral movement while said means engages the central portion of the forward face of a log.

2. The device of claim 1, further comprising centering means carried by said device and disposed along the lower track upstream of said cutting means for aligning the longitudinal axis of a log passing therealong with said cutting means.

3. The device of claim 1, wherein said lower track and said upper track lie in a common vertical plane.

4. The device of claim 3, wherein said first drive means comprises an endless chain disposed in said common vertical plane and an upper portion thereof disposed in said lower track, means for driving said first chain in a first direction along said track.

5. The device of claim 4, wherein said lower gripping means comprises at least one dog mounted on said chain and extending outwardly therefrom in said plane.

6. The device of claim 5, wherein said second drive means comprises a second endless chain disposed in said common plane, a lower portion thereof disposed in said upper track and means for driving said second chain in a first direction along said track.

7. The device of claim 6, wherein said upper gripping means comprises at least one dog mounted on said chain and extending outwardly therefrom in said plane.

8. The device of claim 7, wherein the distal portion of said upper dog is disposed to ride in said lower track as said dog is driven along said upper track.

9. The device of claim 8, wherein a plurality of mutually spaced dogs are mounted on each of said upper and lower chains, said device further comprising sequencing means for driving said chains and spacing said dogs so that an upper and a lower dog engage each log to be fed through said cutting center and release the center flitch after it passes therethrough.

10. The device of claim 9, further comprising conveying means disposed on either side of said lower track for conveying the sides removed from each log in said cutting center.

11. The device of claim 9, wherein each of said chains extend between a pair of sprocket wheels disposed at either end of the respective upper and lower tracks, said lower wheels adapted to normally rotate in said first direction and said upper wheels adapted to normally rotate in a direction opposite thereto.

12. The device of claim 11, wherein a motor means is coupled to one of said wheels in each of said pairs to drive said wheel.

* * * * *